US006003259A

United States Patent [19]

Krapf et al.

[11] Patent Number: 6,003,259

[45] Date of Patent: Dec. 21, 1999

[54] TRANSPARENT HANGER BAR FOR DOCUMENTS

[75] Inventors: Wallace A. Krapf; Dean A. Pilsbury, both of Macedon, N.Y.

[73] Assignee: W. A. Krapf, Inc., Macedon, N.Y.

[21] Appl. No.: 09/120,473

[22] Filed: Jul. 23, 1998

[51] Int. Cl.[6] ..... G09F 3/20; G09F 3/18; A47B 97/04

[52] U.S. Cl. ..... 40/658; 40/661; 248/452

[58] Field of Search ..... 40/658, 611, 793, 40/124, 661; 248/444.1, 452

[56] References Cited

U.S. PATENT DOCUMENTS

| | | | |
|---|---|---|---|
| 1,521,167 | 12/1924 | Achterkirsh et al. | 40/611 |
| 3,399,429 | 9/1968 | Goodman | 24/67 R |
| 3,533,177 | 10/1970 | Tott | 40/661 |
| 3,591,013 | 7/1971 | Herrmann | 211/50 |
| 4,196,535 | 4/1980 | Heimo | 40/735 X |
| 4,199,173 | 4/1980 | Greenlees | 281/45 |
| 4,829,691 | 5/1989 | Manjos et al. | 40/661 |
| 4,908,912 | 3/1990 | Grant | 40/658 |
| 5,082,229 | 1/1992 | Dahl | 248/444.1 |
| 5,152,490 | 10/1992 | Deutsch | 248/452 |
| 5,375,806 | 12/1994 | Debus et al. | 248/452 |
| 5,625,969 | 5/1997 | Vogler | 40/611 |
| 5,697,594 | 12/1997 | Adams et al. | 248/444.1 X |
| 5,881,484 | 3/1999 | Carroll | 40/611 X |

FOREIGN PATENT DOCUMENTS

| | | | |
|---|---|---|---|
| 2109788 | 9/1972 | Germany | 248/452 |

*Primary Examiner*—Anthony Knight
*Assistant Examiner*—Marcus Dolce
*Attorney, Agent, or Firm*—Shlesinger, Fitzsimmons & Shlesinger

[57] ABSTRACT

A rigid panel has projecting from the planar face thereof an elongate, transparent housing open at opposite ends and having an elongate slot in the underside thereof. Mounted in the housing is an elongate, transparent, flexible retainer comprising a strip of flexible, transparent acetate material which is generally U-shaped in cross section, and which has a portion thereof urged resiliently and removably against the face of the panel. The upper edge of a document may be inserted through the slot in the housing and between the panel face and the overlying portion of the retainer strip which retains the document removably and permits all information thereon to be observed through the transparent housing and retainer strip. In a second embodiment the acetate material is wound helically to produce a generally cylindrically-shaped, tubular retainer which is compressed radially to a generally oval cross sectional configuration and is inserted removably into the housing through one end thereof and is allowed to expand radially. A portion of the outer surface of the retainer is urged resiliently against the face of the panel to provide the means for retaining the upper edge of a document in the housing.

13 Claims, 2 Drawing Sheets

TRANSPARENT HANGER BAR FOR DOCUMENTS

BACKGROUND OF THE INVENTION

This invention relates to a device for releasably holding documents, and more particularly to a transparent hanger bar device for releasably holding one end to a document in such manner that any information or data printed on the portion of the document which is secured beneath the hanger can be observed and is completely legible.

Heretofore a variety of different devices have been employed for releasably securing one end of a document in a device so that the remainder of the document hangs downwardly from the device and can be observed. One of the disadvantages of prior such devices, however, is that the upper end of the document which is retained in the device is completely blocked from view, so that any printed information on that end of the document cannot be observed while the document is retained in the device. One such device, for example, utilizes a housing having rotatably mounted therein in a plurality of rollers, which are mounted to rotate adjacent the face of the housing about a common axis. One end of a document may then be inserted through a slot in the housing and beneath the peripheral surfaces of the rollers, and in such manner that such end of the document is releasably secured beneath the rollers and an adjacent wall of the housing. Unfortunately, it has been customary in the past to employ solid, opaque or non-transparent rollers, which overlie the end of the document which is secured in the device, and which therefore prevent anyone from observing any information printed on the face of that portion of the document that is positioned beneath the rollers.

Further than this, prior art devices of the type described have been rather expensive to manufacture, and difficult to assemble. Moreover, most such prior art devices have been rather heavy making it difficult to secure the device to the surface of a stationary or movable support.

It is an object of this invention, therefore, to provide a novel, transparent document supporting device which enables one to observe any printed information located on the face of that portion of a document, or a series thereof, which is releasably secured to the device.

A further object of this invention, therefore, is to provide a light-weight document supporting device which is made entirely from transparent materials, so that any information printed on the surface of that portion of the document which is secured to the device, can be observed and read at all times while the document is retained in the device.

Other objects of the invention will be apparent hereinafter from the specification and from the recital of the appended claims, particularly when read in conjunction with the accompanying drawings.

SUMMARY OF THE INVENTION

An elongate, rigid back panel has projecting from the face thereof an elongate, transparent enclosure open at opposite ends thereof, and in which is housed an elongate, transparent flexible retainer strip. The enclosure has a planar top wall extending normal to the face of the panel, a planar front wall extending downwardly from the top wall in spaced, parallel relation to the face of the panel, and an inclined lip section extending from the low edge of the skirt section diagonally inwardly and part way toward the face of the back panel.

In one embodiment the retainer comprises an elongate rectangular strip of a flexible, transparent acetate material having a marginal portion adjacent one longitudinal edge thereof secured to the underside of the enclosure top wall. The remaining portion of the strip which is generally U-shaped in cross section, is folded downwardly and resiliently against the face of the back panel, and then curves upwardly into the space separating the lip section from the back panel and is seated removably against the inside surfaces of the enclosure front wall and lip section. When the upper edge of a document is inserted between the face of the back panel and the overlying portion of the retainer strip, the resilient strip retains the document removably against the back panel and permits all information thereon to be observed through the overlying portions of the transparent enclosure and retainer strip.

In a second embodiment the elongate strip of transparent acetate material initially is wound helically about an elongate axis to produce a generally cylindrically-shaped, tubular retainer. The retainer is then compressed slightly in a radial direction to a generally oval cross sectional configuration, and in such form is inserted removably into the transparent enclosure through one end thereof, and then is allowed to expand radially. A portion of the outer peripheral surface of the retainer is then urged resiliently against the face of the back panel to provide therewith the means for removably retaining the upper edge of a document in the enclosure.

THE DRAWINGS

Figure 1:
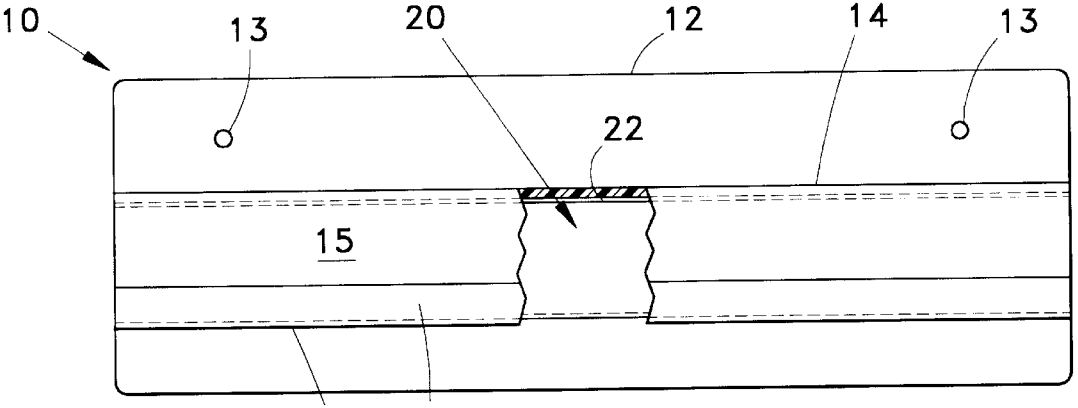
FIG. 1 is a front elevational view of a transparent hanger bar or document supporting device made according to one embodiment of this invention, a portion of the bar being cut away to illustrate part of the flexible, transparent acetate strip, which is mounted on the face of the bar for releasable engagement with a portion of a document that is to be attached to the bar.
Figure 2:
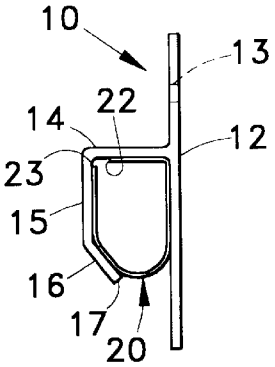
FIG. 2 is an end elevational view of this device as seen when looking in the right end of the hanger bar as shown in FIG. 1.
Figure 3:
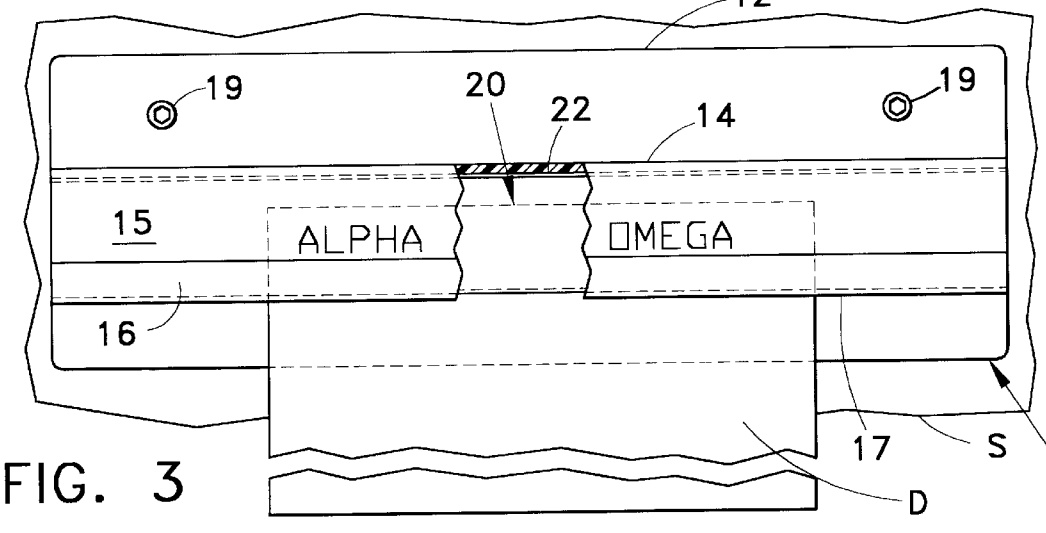
FIG. 3 is a front, fragmentary elevational view of the hanger bar device as it appears when mounted on a vertical wall or support with a document secured at its upper end in the device, and illustrating the manner in which information printed on the face of the document (the words ALPHA and OMEGA) can be readily observed.
Figure 4:
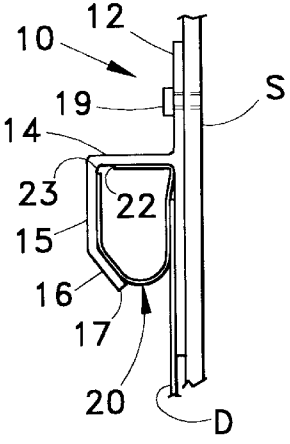
FIG. 4 is a fragmentary right end elevational view of the hanger bar and support therefor as shown in FIG. 3.
Figure 5:
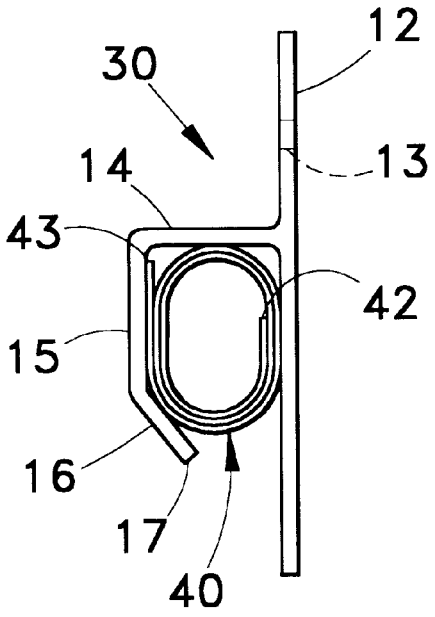
Figure 6:
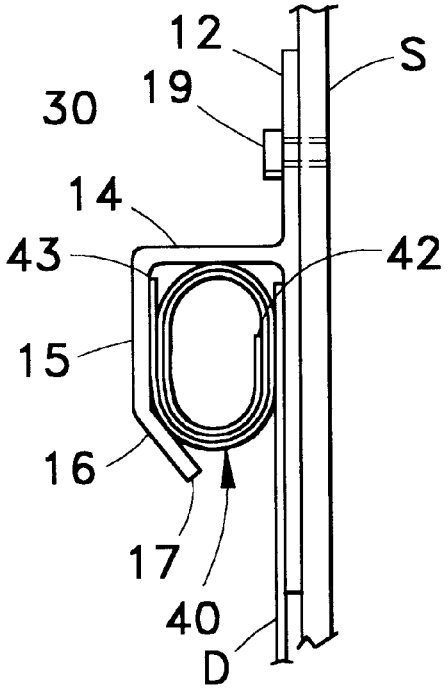
Figure 7:
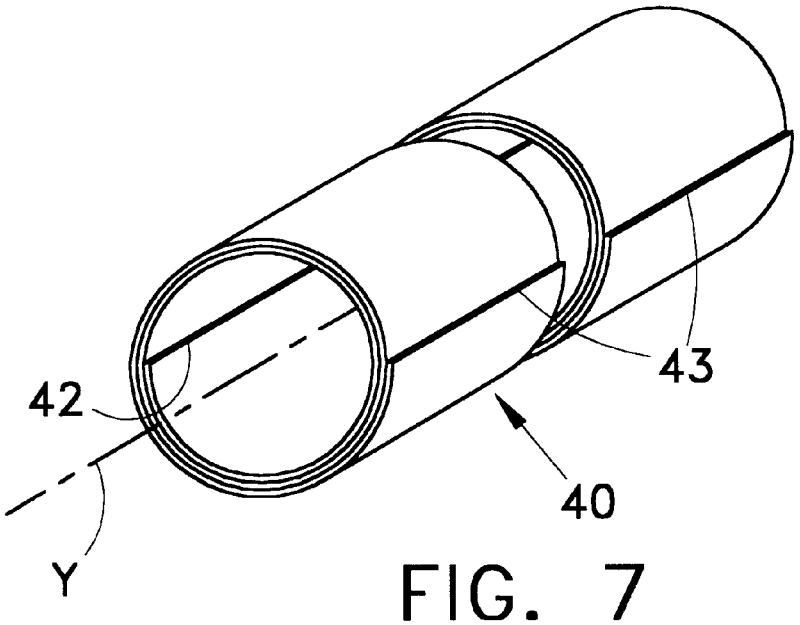

FIG. 5 is an elevational end view of an embodiment of the device generally similar to that shown in FIG. 2, but on a slightly larger scale, and illustrating a modified form of the invention in which the acetate document retainer strip is wound helically about a longitudinal axis to form a generally oval shaped strip which is removably mounted on the hanger bar in place of the generally U-shaped strip shown in FIGS. 1 to 4;

FIG. 6 is an elevational end view generally similar to FIG. 5 but illustrating the modified hanger bar device as it appears when mounted on a vertical wall or support and with the upper end of a document releasably secured beneath the helically wound acetate retainer strip; and FIG. 7 is a slightly enlarged, fragmentary perspective view of the helically wound retainer before it is inserted into the hanger bar.

DETAILED DESCRIPTION OF THE PREFERRED EMBODIMENTS

Referring now to the drawings by numerals of reference, and first to the embodiment shown in FIGS. 1 to 4, 10 denotes generally an elongate, rigid hanger bar made from, for example, an extruded, transparent buterate plastic. Bar 10 includes an elongate, rigid back panel 12, which is generally rectangular in configuration, and which has therethrough adjacent its upper end a plurality of openings 13 (two in the embodiment illustrated) for mounting the panel 12 on a vertical support, such as a wall or the like, as noted hereinafter. Integral with and projecting at right angles from the front surface of panel 12 approximately medially of the longitudinal side edges thereof, and extending between opposite ends of the panel is an elongate shelf or flange 14, which in plan is rectangular in configuration. Integral with and projecting at right angles downwardly from the outer edge of shelf 14 (the edge thereof remote from panel 12) is an elongage, planar skirt section 15 which is disposed in spaced, parallel relation to the face of panel 12 from which the shelf 14 projects. Integral with the lower edge of the skirt section 15 of the bar 10, and inclined therefrom slightly inwardly toward the face of the back panel 12 is an inclined or diagonally extending lip section 16, which also is generally planar in configuration, and which extends longitudinally of the bar between opposite ends thereof. The lower, longitudinally extending edge 17 of the section 16 is thus equispaced from the face of the back panel 12, but at a distance slightly less than the space separating panel 12 from the skirt section 15 of the bar. All portions of bar 10, as noted above, are made of transparent material.

Sections 14, 15 and 16 of the bar 10 cooperate with the face of the back panel 12 to form beneath section 14, and in the space between panel 12 and the sections 15 and 16 of the bar, an enclosure opposite ends of which are open, and the underside of which (FIGS. 2 and 4) has formed therein another opening defined by the space separating the face of panel 12 and the lower edge 17 of the bar section 16. Mounted in this enclosure is an elongate, transparent, flexible retainer strip which is denoted generally by the numeral 20. Strip 20, before being inserted into the hanger bar 10, comprises an elongate transparent strip of acetate material which is generally rectangular in configuration, and which has opposed, longitudinally extending, parallel side edges 22 and 23, which are approximately equal to the length of the overall length of bar 10. Upon being mounted in the enclosure formed by panel 12 and sections 14–16 of hanger 10, a marginal portion of the acetate strip along one longitudinal side edge thereof, the side edge denoted by numeral 22 in FIGS. 2 and 4, is glued or otherwise adhered to the underside or inside surface of section 14 so that edge 22 confronts the inside surface of section 15. The remaining, unadhered portion of strip 20 extends downwardly, as shown in FIGS. 2 and 4 along the inside face of the panel 12, and then is curved or folded upwardly to extend along the inside surfaces of the bar sections 16 and 15, and so that the other longitudinal side edge 23 of the strip 20 is seated freely against the inside surface of the bar section 15 just beneath the shelf section 14.

With this construction the unadhered portion of strip 20 engaging the inside surface of panel 12 is urged resiliently against such surface by the portions of the strip engaged with sections 15 and 16. Also, while the one longitudinal side edge 22 of the strip 20 is secured against removal from the bar 10, the remaining portion of the strip, inclusive of its other longitudinal side edge 23, is free to be moved relative to the sections 14, 15 and 16 of the bar 10. However, the inclined section 16 of the bar tends releasably to retain a substantial portion of strip 20 against the inside surfaces of the bar sections 15 and 16. Thus, if for some reason it becomes necessary, or even if it occurs accidentally, that a portion of the strip 20 is withdrawn from engagement with the bar sections 15 and 16, the strip 20 can still be folded once again to reengage a substantial portion thereof with the inside surfaces of the sections 15 and 16, as shown for example in FIG. 4.

In use, the illustrated embodiment of panel 12 is adapted to be secured to a vertical wall or support S by screws 19 which thread through the panel openings 13 into the face of support S. A document D, or a small stack thereof can then be releasably secured as in FIGS. 3 and 4 adjacent the upper end thereof in the hanger bar 10 simply by inserting the upper end of the document(s) upwardly against the face of the back panel 12, and beneath that portion of the retainer strip 20 which normally is retained resiliently against the face of the panel 12 by virtue of the flexibility of the retainer 20. Because the lower end of the retainer 20 is rounded, as shown in FIGS. 2 and 4, it is a relatively simple matter to insert documents slidably beneath strip 20, as shown in FIGS. 3 and 4, until the upper edge of the document D approaches the portion of the strip that is fastened to section 14. The presence of the document D beneath the strip 20 causes a portion thereof to be urged resiliently against the face of the document D adjacent the upper edge thereof, and in so doing frictionally and resiliently retains the document against the face of the panel 12. In this position, as noted in FIG. 3, any printing or data otherwise existing on the face of the document D adjacent its upper edge, such as for example the Greek Letters ALPHA and OMEGA, will be visible through the overlying transparent portions of bar 10 and strip 20. To remove the document D, one need only to withdraw the document manually downwardly from the bar, and from beneath the strip 20.

Referring now to the embodiment shown in FIGS. 5 and 6, wherein like numerals are employed to denote elements similar to those shown in the first embodiment, 30 denotes generally a modified hanger bar having a back panel 12 and sections 14, 15 and 16 forming an enclosure at the face thereof, but in this embodiment the bar 30 has mounted therein a modified, flexible retainer strip which is denoted generally by the numeral 40. As in the first embodiment the retainer strip 40 is made from a transparent strip of plastic acetate material, but rather than being generally U-shaped in cross section, modified strip 40 is made in the form of a helically wound strip which, when inserted in the bar 30, as shown for example in FIG. 5, normally is generally oval in cross sectional configuration.

Before reaching its oval configuration, the flexible, acetate strip which is employed to manufacture the retainer strip 40, initially has the shape of an elongate, rectangular strip having opposed, parallel end edges, and opposed, longitudinally extending side edges, which are denoted in FIGS. 5 to 7 by their numerals 42 and 43. The rectangular strip is then wound helically about a longitudinally extending axis Y (FIG. 7) thus producing a generally cylindrical or tubular shaped retainer which is also denoted by the numeral 40 in FIG. 7. The cylindrally shaped retainer 40 is then squeezed or slightly compressed in a direction radially of its axis to form the retainer into the oval shaped configuration denoted by numeral 40 in FIG. 5, at which time the oval-shaped retainer can then be inserted into the housing 30 to be retained between the back panel 12 and the enclosure sections 14, 15 and 16. Ideally at this stage the portion of strip 40 adjacent its outer edge 43 is engaged against the inside of the wall section 15, and with edge 43 confronting the underside of section 14 adjacent its juncture with section 15. Consequently, when the hanger bar 30 and its associated retainer 40 are viewed from the end thereof as shown in FIGS. 5 and 6, which corresponds to the right end of the bar shown in FIGS. 1 and 2, the retainer 40 will appear to have been wound in a clockwise direction about the axial centerline of the retainer. In this manner when a document D that has been inserted between the face of the back panel 12 and the confronting surface of the retainer 40 (See FIG. 6) is subsequently withdrawn, it will not cause the edge 43 to be withdrawn out of the housing formed by the cooperating sections 14, 15 and 16.

From the foregoing it will be apparent that the present invention provides a relatively simple and inexpensive means for providing a document holder which is relatively inexpensive to manufacture and assemble, and which can be made in a variety of lengths to accommodate documents of varying widths. In any case, whenever a document is inserted beneath the retainer and against the face of the back panel 12, all the information appearing on the face of the document will be readily observable through the transparent bar sections 14, 15 and 16, as well as the transparent retainer 20 and 40. Also, in the case of the second embodiment, the retainer 40 can be removed and replaced, whenever it is desirable, simply by sliding retainer 40 out of either end of the housing created by the sections 14, 15 and 16.

While this invention has been illustrated and described in detail in connection with only certain embodiments thereof, it will be apparent that it is capable of still further modification. For example, instead of employing screw 19 to mount panel 12 on a support S, it will be apparent to one skilled in the art that other means, such as magnetic, adhesive or hook and loop fastening devices could be employed. Also, of course, it is not adsolutely essential that the back panel 12 be transparent. It will be apparent also that this application is intended to cover any such modifications as may fall within the scope of one skilled in the art, or the appended claims.

We claim:

1. A device for releasably securing and displaying a marginal portion of a document adjacent one end thereof, comprising an elongate panel having on one side thereof a planar surface, an elongate, transparent housing projecting from said one side of said panel and having an inside surface cooperating with said planar surface to form therwith an elongate enclosure, said housing having a longtiduinally extending edge thereof disposed in spaced, confronting relation to said planar surface whereby a longitudinally extending slot is formed in one side of said housing between said planar surface and said edge of said housing, an elongate, flexible, transparent document retainer strip mounted in a stationary position in said enclosure to extend longitudinally of said housing and transversely of said slot, said retainer strip having a first, planar portion thereof adjacent one side of said slot urged resiliently and removably and in coplanar relation against said planar surface, whereby a marginal portion of a document adjacent one end thereof may be inserted manually into said housing through said slot and between said planar surface and said first portion of said retainer strip to be held releasably thereby, and to be observable through said transparent housing and retainer strip.

2. The device as defined in claim 1, wherein a second portion of said retainer strip adjacent the opposite side of said slot is urged resiliently against said inside surface of said housing, and said first and second portions of said retainer strip are connected by a third portion of said retainer strip which registers with said slot and is curved about an axis extending longitudinally of said housing.

3. The device as defined in claim 1, including means for releasably mounting said panel on a vertical support to cause said slot in said housing to face downwardly.

4. The device as defined in claim 2, wherein said first, second and third portions defining said retainer strip are generally U-shaped in cross sectional configuration and are formed from a single, elongate strip of plastic material.

5. The device as defined in claim 4, wherein said strip of plastic material has two opposed, longitudinally extending side edges, and a marginal portion of said material adjacent one of said side edges is secured to the inside surface of said housing.

6. A device for releasably securing and displaying one end of a document, comprising an elongate panel having on one side thereof a planar surface, an elongate, transparent housing projecting from said one side of said panel and having an inside surface cooperating with said planar surface to form therewith an elongate enclosure, said housing having a longitudinally extending edge thereof disposed in spaced, confronting relation to said planar surface whereby a longitudinally extending slot is formed in one side of said housing between said planar surface and said edge of said housing, an elongate, flexible, transparent document retainer resiliently mounted in said enclosure to extend longitudinally of said housing and transversely of said slot, said retainer having a first portion thereof adjacent one side of said slot urged resiliently and removably against said planar surface, whereby one end of a document may be inserted manually into said housing through said slot and between said planar surface and said first portion of said retainer to be held releasably thereby, and to be observable through said transparent housing and retainer, and said retainer comprising an elongate strip of plastic material wound helically about an axis extending longitudinally of said strip into a cylindrical configuration which is radailly compressed into generally oval cross sectional configuration in said housing.

7. The device as defined in claim 6, wherein said housing is open at opposite ends thereof to allow said strip to be inserted into or withdrawn from either end of said housing.

8. The device as defined in claim 6, wherein said retainer is made from an elongate, transparent strip of acetate material.

9. The device as defined in claim 6, wherein said housing is made from a transparent buterate material.

10. The device as defined in claim 9, wherein said housing and said panel comprise a one-piece extruded assembly made from said transparent buterate material.

11. The device as defined in claim 6, wherein said housing comprises a transparent wall one portion of which is disposed in spaced, parallel relation to said planar surface of said panel, and a further portion of which is inclined diagonally inwardly from said one portion of said wall toward said planar surface and terminates in said longitudinaly extending edge of said housing.

12. The device as defined in claim 11, wherein a second portion of said retainer adjacent the opposite side of said slot is urged resiliently against said one portion and said further portion of said housing.

13. The device as defined in claim 12, wherein said first and second portions of said retainer are connected by a curved portion of the retainer which registers with said slot.

* * * * *